US007237698B2

(12) United States Patent
Jackman

(10) Patent No.: US 7,237,698 B2
(45) Date of Patent: Jul. 3, 2007

(54) PRESSURE ACTIVATED SELF OPENING CONTAINER AND SEAL

(76) Inventor: Brian Francis Jackman, 39 Park St., Hudson, MA (US) 01749

( * ) Notice: Subject to any disclaimer, the term of this patent is extended or adjusted under 35 U.S.C. 154(b) by 293 days.

(21) Appl. No.: 10/761,063

(22) Filed: Jan. 20, 2004

(65) Prior Publication Data

US 2005/0155991 A1 Jul. 21, 2005

(51) Int. Cl.
*B65D 47/10* (2006.01)

(52) U.S. Cl. ..... 222/541.4; 222/541.1; 222/541.3; 222/541.6; 215/232; 215/250; 215/253; 215/270

(58) Field of Classification Search ..... 222/541.4, 222/541.3, 541.1, 541.6, 490–491, 494, 212, 222/107, 213; 215/232, 253, 260, 250, 270–271, 215/350, 354, 344
See application file for complete search history.

(56) References Cited

U.S. PATENT DOCUMENTS 3,071,294 A * 1/1963 Galbierz ..... 222/327
4,696,328 A 9/1987 Rhodes, Jr.
4,789,082 A 12/1988 Sampson
4,830,231 A * 5/1989 Smith ..... 222/327
4,938,390 A * 7/1990 Markva ..... 222/541.4
4,949,857 A 8/1990 Russell
5,353,968 A 10/1994 Good, Jr.
5,634,504 A 6/1997 Chandler
6,206,251 B1 * 3/2001 Williams ..... 222/479

* cited by examiner

*Primary Examiner*—Frederick C. Nicolas

(57) ABSTRACT

A multi layered frangible seal is bonded over the pour spout opening of flexible plastic bottles containing pourable products such as motor oil. The seal provides a leak proof closure that is strong enough to remain intact when the filled uncapped container is held in an inverted position, and at the same weak enough to break open and dispense the contents into a fill opening when a consumer squeezes the inverted container. The seal is constructed from a first layer of leak proof frangible sheet material that is bonded to a second layer of strengthening sheet material. The strengthening layer contains a cut out void configuration that forms a breaking pattern which forces the seal to break open only in the weaker single frangible layered configuration of the cut out void forming the breaking pattern when the container is squeezed.

11 Claims, 10 Drawing Sheets

PRESSURE ACTIVATED SELF OPENING CONTAINER AND SEAL

Elements of the inventive concept described in the specification contained herein also appear in my co-pending application Ser. No. 03945 U.S. PTO 10/694137 Filed Oct. 27, 2003.

FIELD OF THE INVENTION

The invention resides in the area of pressure activated self opening container seals, specifically an improved multi layered sealing closure for sealing over the pour spout opening of flexible plastic bottle containers of the type used for the storage and dispensing of pourable liquids such as motor oil, or motor vehicle additives and the like. When the filled uncapped container is inverted the seal is of sufficient strength to hold the weight of the liquid contents without breaking. At the same time, the seal is also of sufficient weakness to burst open and dispense the contents into a fill opening when a set amount of additional pressure is brought to bear against the seal by a consumer squeezing the inverted container.

BACKGROUND OF THE INVENTION

It is highly desirable and beneficial to provide flexible plastic bottles of the type used for the storage and dispensing of diverse products such as motor oil, transmission fluid, and various other types of motor vehicle additives that have to be poured from the container, with an improved leak proof closure seal that includes a pressure activated self opening feature.

Such bottle types are comprised of a tubular body portion with a sealed bottom end. An opposite top end is comprised of a funnel shaped neck forming a pour spout that includes means for securing a closure cap. The pour spout ends with a flat perpendicular exterior rim that provides a surface area for bonding a seal over the pour spout opening.

This one piece container has gained wide acceptance since introduced and was designed to replace the problematic metal and paperboard can type container being used at the time. Not only did the can type container suffer from a high leakage rate, it would also most likely burst when dropped. Additionally, in order to open the container and dispense the contents, a user was required to provide either a can opener and fill funnel, or a reusable metal pour spout attachment that was pushed into the can top, piercing the metal, and secured by a press fit. This was an inconvenience and as can be seen the much stronger and durable plastic bottle was a great improvement that has made the can type container obsolete.

When such flexible plastic bottle type replacements first came into popular use, there were problems associated with the design of the closure caps that caused seepage and leaking of the contents in many containers beyond acceptable limits. To overcome this flaw many manufacturers added a durable foil seal that was bonded over the pour spout opening by induction sealing and was very effective in preventing any leakage prior to the consumer removing the closure cap and seal. Although performing well in this function, these seals proved to be extremely difficult to be removed by hand, requiring the consumer to provide a sharp tool just to open the product.

To correct this fault, and to promote product ease of use and consumer convenience, manufacturers made advances in closure cap technology and sealing materials for preventing leakage. The induction bonded foil seal was phased out by many manufacturers and replaced with a resilient gasket that is bonded to the underside of the container closure cap and is the primary method currently used by most manufacturers to prevent leakage of the contents.

However, despite the advances made in closure caps to prevent leakage, they have fallen far short of solving the problem. Incorrect torqueing of the screw on closure cap, dropping of the container, jarring through shipping or loading, or poor fit of the gasket, can all cause container leakage prior to the removal of the closure cap. Even with the addition of a locking tear strip at the lower outer perimeter of the closure cap, this type of container can still leak and contains no backup provision to prevent it.

In addition to problems with leakage, a second and more serious disadvantage with the flexible plastic container as currently provided, is the extreme difficulty a user experiences when trying to pour the liquid from the container into a narrow fill opening without the contents spilling everywhere.

In order to accomplish this task, a consumer has to judge where to position the container and then begin to slowly invert the container while trying to keep the pour spout exactly in the right place for the liquid to pour into the fill opening. At this point the consumer has to try to bring the pour spout closer to the fill opening so it can be inserted as the container contents continue to pour out. This has to be accomplished as the liquid stream pulses from air being drawn back into the container to equalize the container pressure. An extremely difficult task even in the best of conditions.

When attempting this procedure it becomes obvious that the likely outcome is the container contents end up being spilled into the engine compartment and then drip on to the ground and pollute the environment. A more serious consideration is the possibility of the contents flowing onto hot engine components creating noxious fumes and possible fire.

Although a motorist can avoid this by using a fill funnel, this also has its drawbacks, the funnel becomes covered by the container contents and has to be cleaned after each use, or too often a funnel isn't available when needed. Garages with an attendant to provide this service have largely been replaced by self service facilities where there is usually no funnel available. Recognizing this need, some self serve gas stations provide a disposable paper funnel, but then a further problem is, these paper funnels become hazardous waste when soaked with petroleum products, are a waste of natural resources, and are of a considerable cost to the consumer in the form of higher prices.

These disadvantages are well known and could be effectively eliminated by the bonding of a leak proof frangible seal over the pour spout opening that is only of sufficient strength to remain intact when subjected to the pressure created by the weight of the liquid contents when the filled uncapped container is held in an inverted position. At the same time, the seal would also have to be sufficiently weak enough to fail and burst open from the additional pressure that can be brought to bear against the seal by a consumer squeezing the filled uncapped container when held in the inverted position. A container seal that incorporated this self opening feature would allow a consumer to invert the filled uncapped container and then insert the pour spout into the fill opening without spilling the contents. Then, by squeezing the container, the seal would break open and dispense the contents only into the fill opening thereby eliminating the need of an opening device or fill funnel.

There have been numerous patents granted for container closure seals that include this feature. The prior art patents described herein offer similar and differing designs, materials, and fabrication methods in attempting to provide a pressure activated self opening closure seal that functions in this manner.

U.S. Pat. No. 4,696,328 to Rhodes Jr. describes an embodiment of a single layered airtight rupturable plastic container seal that is bonded to the pour spout rim of a flexible oil bottle that stretches, bursts open, and tears apart in an undefined configuration thereby dispensing the contents when the inverted container is squeezed by a consumer.

U.S. Pat. No. 4,789,082 to Sampson describes an embodiment of a single layered seal for an oil bottle consisting of fabric, metal foil, or plastic wherein a first portion of the seal is bonded to the pour spout rim of a flexible container with a releasable adhesive that allows the seal to detach from the rim and dispense the contents when the inverted container is squeezed by a consumer. A second portion of the seal is bonded to the rim with a fixed adhesive which keeps the seal attached to the pour spout after the container is squeezed to open the seal.

U.S. Pat. No. 4,938,390 to Markva describes a number of embodiments of a sealing closure for an oil bottle. A first embodiment describes a single layered seal wherein a first portion of the seal is bonded to the pour spout rim of a flexible container with a releasable adhesive that allows the seal to detach from the rim and dispense the contents when the inverted container is squeezed by a consumer. A second portion of the seal is bonded to the rim with a fixed adhesive which keeps the seal attached to the pour spout after the container is squeezed to open the seal. A second embodiment describes a single layered seal with various tear lines that is bonded to the pour spout rim of a flexible container wherein no portion of the seal releases from the rim, but tears open along the lines and dispenses the contents when the inverted container is squeezed by a consumer. A third embodiment describes a single layered seal with a tear line that extends across its diameter that is bonded to the pour spout rim of a flexible container. Portions of the seal are bonded to the rim with a releasable adhesive that allows the seal to tear open in two halves along the tear line and partially detach from the rim and dispense the contents when the inverted container is squeezed by a consumer. A portion of each torn half is bonded to the container rim with a fixed adhesive which keeps the detached portions attached to the pour spout. A fourth embodiment describes a seal that consists of a first layer with tear lines that is bonded to the pour spout rim of a flexible container covering over a portion of the pour spout opening wherein no portion of the layer releases from the rim. The remainder of the pour spout opening is covered over by a second layer that partially overlaps, and is bonded to, the first layer and a portion of the rim with a releasable adhesive that allows the second layer to delaminate from the first layer and a portion of the rim to dispense the contents when the inverted container is squeezed by a consumer. A portion of the second layer is bonded to the container rim with a fixed adhesive which keeps the delaminated layer attached to the pour spout. A fifth embodiment describes a seal that consists of a first layer with an opening and a tear line that is bonded to the pour spout rim of a flexible container wherein no portion of the layer releases from the rim. The opening in the first layer is covered over by a second layer that is bonded to the first layer with a releasable adhesive that allows the second layer to delaminate from the first layer and dispense the contents when the inverted container is squeezed by a user. A portion of the second layer is bonded to the first layer with a fixed adhesive which keeps the delaminated layer attached to the first layer.

U.S. Pat. No. 4,949,857 to Russell describes an embodiment of a single layered rupturable seal of non absorbent material that is bonded over the pour spout mouth of a flexible oil bottle. The seal contains an X shaped breaking pattern consisting of weakened lines that rupture and dispense the contents when the inverted container is squeezed by a consumer.

U.S. Pat. No. 5,353,968 to Good Jr. describes a number of embodiments for a single layered closure for a flexible container consisting of varying materials that has lines or areas of relative weakness on its surface. In a first embodiment the lines or weakened portion consists of an X shaped score that can partially penetrate the closure or be a slit, that blows out and dispenses the contents when the inverted container is squeezed by a consumer. In a second embodiment the lines or weakened portion consists of an X shaped series of perforations penetrating the closure that allow the closure to blow out and dispense the contents when the container is squeezed by a consumer. In a third embodiment the weakened portion consists of a thinned central area formed by compression, boring, or any other suitable means that blows out and dispenses the contents when the inverted container is squeezed by a consumer. If any of the above described embodiments of the closure are used on a container of motor oil, the closure may be made of a plastic that melts when any pieces of the closure break off and contaminate the oil going into the engine.

U.S. Pat. No. 5,634,504 to Chandler describes a single layered closure seal consisting of metal foil with a layer of hot melt adhesive used to heat seal the closure to the container rim. The closure seal contains a repeating fracture pattern that allows the seal to burst open and tear along the lines of the fracture pattern when the container is inverted and squeezed by a consumer. The seal contains vent holes to equalize the internal container pressure with the atmospheric pressure.

The prior art patents described herein collectively employ a number of similar and differing seal design and fabrication methods in attempting to construct a container closure that bursts open when subjected to container squeezing pressure. However, each of the embodied design methods employed by the prior art and described herein, manifest similar and differing drawbacks.

A first method makes use of a single layered seal that is bonded over the container opening with a fixed adhesive. The seal bursts open in an undefined configuration when sufficient pressure is applied by squeezing the inverted container such as described in U.S. Pat. No. 4,696,328 to Rhodes Jr. However, this method gives no provision for the possibility that portions of the seal material may tear away and contaminate the contents when the seal bursts open, which could damage the motor by clogging the internal flow of lubrication to critical components.

A second method makes use of a single layered seal that is bonded over the container opening with a fixed adhesive. The seal bursts open in a central thinned area when sufficient pressure is applied by squeezing the inverted container such as described in an embodiment of U.S. Pat. No. 5,353,968 to Good Jr. To overcome the drawback that portions of the seal material may tear away and contaminate the contents when opened, which could damage the motor by clogging the internal flow of lubrication, the seal can be made from a material that melts in the heated oil when the motor reaches its operating temperature. However, with this method there is no provision given for the possible damage that may be caused to the motor by altering the lubricating qualities of the oil by repeatedly contaminating it with melted seal material, or that portions of the seal material may tear away when opened and damage the motor during warm up by clogging the internal flow of lubrication to critical components when a consumer inadvertently adds oil to a cold engine. There is also the inconvenience of having to wait for the motor to warm up before being able to add oil.

A third method makes use of a single layered seal that is bonded over the container opening with a releasable adhesive wherein one or more portions of the seal delaminate from the rim when sufficient pressure is applied by squeezing the inverted container. The seal material is kept from completely detaching from the container by bonding one or more portions of the seal to the pour spout with a fixed adhesive such as described in U.S. Pat. No. 4,789,082 to Sampson and embodiments of U.S. Pat. No. 4,938,390 to Markva. However, with this method there is no provision given for the possibility that using a releasable adhesive with a bond strength that is weak enough to allow the seal to delaminate from the container rim when the inverted container is squeezed, would also allow the seal to delaminate when the closure cap is rotated. The amount of pressure applied against the seal when the closure cap is torqued on or off is many times greater than the small amount of adhesive strength required to allow the seal to delaminate from the pour spout rim when the inverted container is squeezed. Rotation of the closure cap while it is compressed against the seal during installation or removal produces a shearing force that could force the releasable portion of the seal to lose its bond and rotate with the cap which would cause the seal to pleat against the fixed portion resulting in leakage and opening of the seal. Additionally a tack type releasable adhesive with low adhesion characteristics could also be vulnerable to degradation from the volatile organic compounds present in many petroleum based products that could negatively affect the seals ability to remain bonded to the container rim when a given pressure is brought to bear.

A fourth method makes use of a seal that consists of a first layer with an opening that is bonded to the container rim with a fixed adhesive. The opening is covered over by a second layer that is bonded to the first layer with a releasable adhesive that allows the second layer to delaminate from the first layer when sufficient pressure is applied by squeezing the inverted container. The second layer is kept from completely detaching from the container by bonding a portion of the second layer to the first layer with a fixed adhesive such as described in embodiments of U.S. Pat. No. 4,938,390 to Markva. Again, with this method, there is no provision given for the possibility that using a releasable adhesive with a bond strength that is weak enough to allow the second layer to delaminate from the first layer when the inverted container is squeezed, would also allow the second layer to delaminate from the first layer when the closure cap is rotated. The amount of pressure against the seal when the closure cap is torqued on or off is many times greater than the small amount of pressure required to allow the second layer to delaminate from the first layer when the inverted container is squeezed. Rotation of the closure cap while it is compressed against the seal during installation or removal produces a shearing force that could force the releasable portion of the second layer to lose its bond and rotate with the cap which would cause the second layer to pleat against the fixed portion resulting in leakage and opening of the seal. Additionally a tack type releasable adhesive with low adhesion characteristics could also be vulnerable to degradation from the volatile organic compounds present in many petroleum based products that could negatively affect the second layers ability to remain bonded to the first layer when a given pressure is brought to bear.

A fifth method makes use of a single layered non leak proof seal that is bonded over the container opening with a fixed adhesive. The seal contains a weakened fracture pattern with vent holes or an area that is weakened by perforations or creased slits and when sufficient pressure is applied by squeezing the inverted container the seal is forced to burst open and tear only in the configuration of the fracture pattern, perforations or slits as described in embodiments of U.S. Pat. No. 4,938,390 to Markva, embodiments of U.S. Pat. No. 5,353,968 to Good Jr. and U.S. Pat. No. 5,634,504 to Chandler. However, with this method there is no provision given for the problem of the seal leaking through the perforations, slits, or vent holes during shipping or handling. To prevent this, it would be necessary to include an additional seal in the form of a resilient gasket between the closure cap and the seal which would increase the cost of the container. Additionally, the vent holes, slits, or perforations would also leak from the pressure created when the container is gripped and inverted by a consumer which would allow the container contents to drip into the motor compartment making a mess or worse drip onto hot engine components creating noxious fumes and possible fire.

A sixth method makes use of a single layered seal that is bonded over the container opening with a fixed adhesive. The seal contains a weakened breaking pattern that is created by thinning the seal material. Various thinning techniques are employed by the prior art to accomplish this, including; scoring, milling, boring, compression, molding or laser cutting. When sufficient pressure is brought to bear against the seal by squeezing the inverted container, the seal is forced to burst open and tear only in the weaker thinned area of the breaking pattern configuration as described in U.S. Pat. No. 4,949,857 to Russell, and embodiments of U.S. Pat. No. 5,353,968 to Good Jr. However, using any of the various techniques described in these two prior art patents to fabricate a thinned breaking pattern that will leave the precise material thickness necessary for the seal to remain intact when the filled container is lightly gripped and inverted, and then consistently burst at a squeezing pressure that by necessity has to be very low, present considerable manufacturing and fabrication drawbacks described herein.

The burst pressure of the seal cannot be determined by the maximum amount of squeezing force that a consumer can comfortably apply to the inverted container. The higher the burst pressure of the seal, the more likely the volume of liquid gushing out of the container pour spout will exceed the inflow capacity of the fill opening which will cause the liquid to back up and overflow when the seal bursts open. Therefore it is essential that the amount of additional squeezing force necessary to burst open the seal when the container is held by a consumer in the inverted position, must be kept as close to zero as possible, while still leaving the seal strong enough to remain intact when the filled uncapped container is gripped and inverted.

Additionally, the laws of fluid dynamics dictate that because the bore of the container is many times greater than the bore of the pour spout opening, the squeezing pressure applied to the container will also be many times greater than the pressure that the squeezing action brings to bear against the seal. This has the effect of multiplying the amount of squeezing pressure necessary to burst the seal and, consequently, will equally increase the internal pressure of the container and the volume of liquid gushing out of the pour spout when the seal breaks open. This further adds to the requirement that any additional thickness of material in the thinned area greater than that necessary for the seal to remain intact when the container is gripped and inverted, must be kept to the absolute minimum that is practically attainable.

When the uncapped container is inverted the weight of the liquid contents, together with the additional pressure created by a consumer gripping the container, produces lateral force that pushes against the seal. This lateral force creates tension in the seal that is opposed by the tensile strength of the seal material. For the seal to burst the lateral force must be increased to a degree sufficient to overcome the tensile strength of the seal material in the thinned area of the breaking pattern. The tensile strength of the seal material, and henceforth the amount of container pressure required to burst the seal, is determined by the type of material used and its thickness in the thinned area. When the tensile strength of the seal material being used and the required burst pressure of the seal are known, the exact minimum material thickness necessary for the seal to remain intact when the container is gripped and inverted, can be determined.

For example, because of its reliability, low cost, and adaptability to high speed fabrication and installation, the packaging industry has universally adopted induction sealing as the method of choice for installing closure seals on many types of containers including those used for pourable motor vehicle additives. An induction bonded type container seal consists of a layer of metal foil with one side coated with a layer of hot melt adhesive. The opposite side of the foil seal is laminated to a layer of absorptive material, such as pulp board, with a layer of heat releasable adhesive, such as micro crystalline wax. The assembled seal disk is inserted into the closure cap which is then installed over the pour spout opening. This presses the hot melt adhesive side of the seal against the container rim. The container is then passed through an induction sealer that generates a high voltage discharge which is conducted by the metal foil layer of the seal causing it to heat up. The hot foil layer in turn melts the hot melt adhesive layer which bonds the seal to the container rim and simultaneously melts the wax layer which is then absorbed into the pulp board thereby releasing the seal. The pulp board is then retained in the cap when it is removed from the container leaving only the foil seal bonded over the container opening.

Because of its high conductivity, high strength to weight ratio, low cost, and other desirable qualities, aluminum is used almost exclusively in the industry for the foil layer. Excluding the hot melt adhesive layer, which is generally thicker and stronger than the foil layer, the aluminum foil used for these seals is typically a few thousandths of an inch thick. Based on the volumetric weight of the contained liquid and the width of the pour spout opening of a typical container of the type described herein, the pressure produced and brought to bear against the seal when the container is lightly gripped and inverted can be held by an adhesive free single layered aluminum foil seal with a thinned breaking pattern that measures approximately one ten thousandth of an inch thick (0.0001") and is herein referred to as the base thickness. Even a base thickness of two ten thousandths of an inch (0.0002") produces a bursting pressure that is far too high. Therefore, in order for the seal to consistently burst with the minimal amount of additional squeezing pressure required, the base thickness of the seal material in the thinned area of the breaking pattern must be able to be adjusted upwardly with an accuracy that approaches one one hundredth thousandth of an inch thick (0.00001"), and if other types of seal material are used, the base thickness of the breaking pattern using those materials would also have to be able to be adjusted upwardly with similar dimensional accuracy in order for the seal to burst at the precise pressure required.

As can be seen, setting the exact burst pressure necessary for a self opening seal to function properly requires a seal design that allows the process of thinning the material to form the breaking pattern to be controlled with extreme precision. When a weakened breaking pattern has to be created by thinning an area of the seal material to approximately one ten thousandth of an inch thick, within tolerances approaching one one hundredth thousandth of an inch (0.00001"), as is the case with aluminum foil, each of the various thinning schemes used in the prior art patents such as; scoring, milling, boring, compression, molding, or laser cutting fail to provide the control necessary to meet these requirements.

For example, forming the thinned area of the breaking pattern in the seal material by scoring requires that some type of cutting tool be drawn across the surface of each individual seal. This requires that the scoring tool must be kept approximately one ten thousandth of an inch above the bed of a scoring machine as it cuts a relatively deep breaking pattern into a thin layer of delicate seal material a few thousandths of an inch thick, while also keeping the depth of the score within tolerances approaching one one hundredth thousandth of an inch. It should be immediately obvious even to those unskilled in the art, that the seal material will most likely tear when this is attempted. Even if this could be accomplished at all, it would be a very time consuming process that would most likely produce quality control problems and a high defect rate which would cause inconsistent burst pressures from one seal to the next.

To form the thinned area of the breaking pattern by boring or milling requires that a rotating cutter be kept approximately one ten thousandth of an inch above the bed of a machine tool as it cuts a relatively deep breaking pattern into a thin layer of delicate seal material a few thousandths of an inch thick while also trying to maintain the depth of the cut to within tolerances approaching one one hundredth thousandth of an inch. Again, it should be immediately obvious even to those unskilled in the art that the seal material will most likely tear when this is attempted. Even if this could be accomplished at all, it would also be a very time consuming process that would again, most likely produce quality control problems and a high defect rate which would cause inconsistent burst pressures from one seal to the next.

Creating the thinned area of the breaking pattern by compression would require that some type of die, knife edge or V shaped anvil be pressed into various seal materials. Again, the ability to consistently control the depth of a groove that leaves the thinned area of the breaking pattern with the extremely thin and precise dimension necessary for the seal to function properly is beyond the capabilities of a die press. Drawbacks such as allowable machine tolerances or incremental tool wear alone would be sufficient to produce defects that would cause inconsistent or premature bursting of the seal.

Manufacturing a self opening seal with a thinned breaking pattern using a molding process such as injection or vacuum forming requires the seal to be fabricated from heated plastic material which presents a number of significant disadvantages. Each seal must be made individually and cannot be stamped out from roll stock in a high speed fashion. Because of the elasticity and expansion coefficient of plastic materials, the ability to consistently control the depth of the thinned area of the breaking pattern to the tolerances required is beyond the capabilities of either process. Injection molding and vacuum forming also require expensive multi cavity molds that must be replaced regularly adding to the unit cost of each seal. Manufacturing the closure seal by molding is also a time consuming process which would also add to the unit cost of each seal.

And lastly, creating the thinned area of the breaking pattern by laser cutting would present different but even more intractable problems. Attempting to melt the seal material to a particular depth with a laser will not produce a precisely thinned breaking pattern. An industrial laser is ideally suited to cutting completely through any type of material in a very precise manner, for instance, to create slits or perforations, but it is totally ineffective when attempting to use it as a scoring device or milling machine. The process of thinning the seal material by the use of a laser requires the beam to be of sufficient heat to vaporize the seal material to a precise depth. A laser beam that is hot enough to vaporize any type of seal material would not just stop at a certain depth when the laser is either pulsed or moved across the surface. Vaporizing the seal material with the use of a laser is an explosive event that would not leave the precisely thin and delicate layer of intact material necessary for the seal to function properly, if it left any material at all. This method would also be a time consuming process that would add to the unit cost of each seal.

As can be seen when U.S. Pat. No. 4,949,857 to Russell. and U.S. Pat. No. 5,353,968 to Good Jr. are closely examined, each falls far short of providing a self opening seal design that allows the thickness of the material in the thinned area of the breaking pattern to be controlled with the precision necessary for the seal to burst at the precise pressure required. Additionally, the design of each of the prior art seal embodiments require fabrication methods do not allow the closure to be easily manufactured in a high speed manner that will produce a defect free seal at the lowest possible cost.

In addition to the aforementioned drawbacks in all of the prior art patents, a further drawback is the inability of any of the closure seal embodiments to be manufactured and bonded over a container opening by using the existing induction sealing process which is a significant disadvantage. To fabricate an induction type seal disk, as previously described herein, a layer of hot melt adhesive is applied to one side of a long continuous roll of metal foil sheet and allowed to dry. A layer of hot, heat releasable adhesive is then applied to the opposite side of the foil sheet which becomes tacky after cooling. A continuous sheet of rigid absorptive pulp board from a second roll is then laminated to the releasable adhesive side of the foil roll by rolling both sheets together under pressure. This process produces a single long roll of laminated sheet material that contains all the necessary layers of foil, adhesives, and pulp board needed to complete the seal. The finished seal disk is then die cut from the roll and installed in the closure cap at the at the assembly point. The prior art patents described herein cannot utilize this efficient fabrication and installation method for a variety of similar and differing reasons thereby preventing the prior art from benefiting from the economies realized.

For instance, the closure seal of U.S. Pat. No. 4,696,328 to Rhodes Jr. is fabricated from thin rupturable plastic that will not conduct a high voltage current. The closure seal of U.S. Pat. No. 4,789,082 to Sampson uses both a first fixed adhesive that would have to be a hot melt type and a second releasable adhesive that could migrate to the area between the fixed adhesive and the rim when the closure cap is rotated under pressure which could degrade the ability of a hot melt adhesive to provide a proper bond. The closure seal of U.S. Pat. No. 4,938,390 to Markva uses variations of two different self opening designs. A first design consists of a one or two layered seal that uses both a first fixed adhesive that would have to be a hot melt type and a second tacky releasable adhesive that could migrate to the area between the fixed adhesive and the rim or between the fixed adhesive of a first layer and a second layer when the closure cap is rotated under pressure which could degrade the ability of a hot melt adhesive to provide a proper bond. A second design consists of a single layered seal containing what appears to be various perforated tear line configurations. The hot melt adhesive layer used to bond an induction seal to a container rim becomes viscous when melted which could cause the adhesive to reseal the perforations of the tear lines and prevent the seal from bursting. To eliminate this requires that the adhesive be zone specific applied to each individual seal only in the area contacting the rim, an inefficient and time consuming process that cannot be incorporated into the existing induction sealing process. The closure seal of U.S. Pat. No. 4,949,857 to Russell uses a weakened breaking pattern that would be prevented from bursting by the underlying layer of hot melt adhesive, also requiring the adhesive to be zone specific applied to each individual seal only in the area contacting the rim, again an inefficient and time consuming process that cannot be incorporated into the existing induction sealing process. The closure seal of U.S. Pat. No. 5,353,968 to Good Jr. uses two variations of two different designs for a self opening seal. A first design consists of a closure seal with a breaking pattern that is weakened by slits or perforations. A second design consists of a closure seal with a breaking pattern that is weakened by being thinned in various ways. Again, the necessary layer of hot melt adhesive prevents both designs from being able to be adapted to the induction sealing process either by resealing the slits or perforations when melted or not allowing the thinned area of the breaking pattern to burst when the container is pressurized. To over come this the hot melt adhesive would also have to be zone specific applied to each individual seal only in the area contacting the rim, again a time consuming process for fabricating large quantities of the closure seal that cannot be incorporated into the existing induction sealing process. The closure seal of U.S. Pat. No. 5,634,504 to Chandler uses a single layered seal that contains vent holes and what appears to be either a perforated or scored fracture pattern. In either case the necessary layer of hot melt adhesive would again prevent the seal from bursting properly by possibly resealing the narrow perforations when the adhesive melts or preventing the seal from bursting at all if just scored, thereby requiring that there be no adhesive in the area of the scores or perforations. Again, the adhesive would have to be applied in a zone specific fashion only in the area where the seal contacts the rim of the container which cannot be incorporated into the existing induction sealing process.

OBJECTS AND ADVANTAGES

The principal object of my present invention is to provide an improved pressure activated self opening container closure seal that is strong enough to remain intact when the filled uncapped container is gripped and inverted, and also weak enough to burst open when a consumer squeezes the inverted container to dispense the liquid contents.

It is a further object of the invention to provide a closure seal that allows the burst pressure of the seal to be precisely set at a squeezing pressure that the average consumer would find easy to apply.

It is a further object of the invention to provide a closure seal that bursts at a precise pressure that is consistent from one container to the next thereby allowing the seal to function as intended with a high degree of reliability.

It is a further object of the invention to provide a container seal that is economical to produce in large quantities using existing materials, manufacturing equipment, and methods that are familiar to those skilled in the art.

It is a further object of the invention to provide a self opening container seal that is leak proof, adaptable to existing containers and closure caps, and can be installed using the existing induction sealing process.

It is a further object of the invention to provide a closure seal that can be bonded over the container opening without any adhesive layers interfering with the ability of the seal to open properly.

It is a further object of the invention to provide a container closure seal that allows the broken open portion to remain attached to the container thereby avoiding any contamination of the dispensed contents.

It is a further object of the invention to provide a closure seal, that after breaking open, can be easily removed from the container in its entirety including any peripheral portion remaining bonded to the container rim which allows the container to be recycled without any of the seal material contaminating the empty container.

It is a further object of the invention to provide a closure seal that is impervious to the container contents and will maintain its integrity over an extended period of time on the shelf.

It is a further object of the invention to provide a pressure activated self opening closure seal with specific improvements that allow the seal to overcome all of the disadvantages inherent in the prior art.

My invention achieves these and other objectives by constructing the seal with two separate layers of material that are bonded together. A first layer of weak leak proof frangible material that can be rolled to a precise thickness is bonded to a second layer of strengthening material. The second layer of strengthening material contains a cut through and/or cut out void configuration forming a breaking pattern that leaves a weakness in the multi layered seal only where the first frangible layer covers over the void area of the breaking pattern. This material arrangement turns the second layer into a break and tear template layer which forces the multi layered seal to burst open and tear only in the single frangible layered area of the breaking pattern when the container is pressurized by squeezing. The use of a separate layer of material to create the thinned area of the breaking pattern allows the bursting pressure of the seal to be set precisely. This is accomplished by the ability of current state of the art multi head rolling mills to produce a continuous roll of the ultra thin frangible layer material with the exact thickness and consistency required.

The second template layer is fabricated by stamping repeating breaking patterns, along with position indicators, into a continuous roll of standard induction foil sheet material that has the hot melt adhesive layer previously applied to a first side. This process leaves the layer of hot melt adhesive intact every where except in the area of the breaking pattern. A second layer of adhesive can then be applied to the opposite side of the template layer by using a variety of methods well known to those skilled in the art which then allows the frangible layer from a continuous roll to be bonded to the template layer roll without any adhesive being present in the area of the breaking pattern. This leaves only the single frangible layer covering over the cut out void area of the breaking pattern. Continuous rolls of the absorptive material and the multi layered seal material are then pressure rolled and bonded together by a layer of heat releasable adhesive that is applied to the frangible layer. The previously stamped positioning indicators allow the seal disks to then be die cut from a continuous roll of the completed multi layered seal material in a high speed manner producing a finished seal disk with the breaking pattern centered within the disk. The completed multi layered seal disk can then be bonded over the container opening using the standard induction sealing system by inserting the seal disk into a closure cap which is then installed over the container opening. This presses the hot melt adhesive side of the seal against the container rim. The container is then passed through an induction sealer which heats the foil. The hot foil in turn melts the hot melt adhesive layer which bonds the seal to the container rim and simultaneously melts the releasable adhesive layer which is then absorbed into the absorptive layer thereby releasing the seal. The absorptive pulp board disk is then retained in the closure cap when it is removed from the container leaving only the intact pressure activated self opening seal invention bonded over the container opening.

The multi layered design of my present invention provides a number of important advantages and essential features vital to the proper functioning of the seal that are not provided in the prior art patents such as:

The seal is leak proof.

The burst pressure of the seal can be precisely set.

None of the adhesive layers interfere with the seals ability to consistently burst open at a precise pressure.

The seal bursts open without any of the seal material contaminating the dispensed contents.

The seal can be manufactured and installed using the existing induction sealing process.

The seal can be manufactured using existing materials and fabrication equipment.

The seal can be manufactured in a high speed manner with a low unit cost.

These and other objects and advantages of the seal invention can be more fully understood and appreciated by a reading of the following detailed specification.

SUMMARY OF THE INVENTION

The container closure seal of the present invention is specifically concerned with the provision of effective means for sealing over the pour spout opening of flexible containers of the type used for storing and dispensing motor oil or motor vehicle additives and the like. The seal invention eliminates the disadvantages inherent in prior art seals and current container design by providing a leak proof frangible seal that bursts open in the configuration of a breaking pattern when a precise amount of internal container pressure is reached when the filled uncapped container is inverted and squeezed by a consumer.

The principal advantages of the invention are achieved by utilizing a seal made up of a first layer of leak proof frangible sheet material that is bonded to an additional layer of sheet material that contains one or more cut through and/or cut out void configurations forming a breaking pattern that turns the additional layer into a break and tear template layer. Bonding the template layer to the frangible layer strengthens the multi layered seal every where except in the area of the breaking pattern where only the single frangible layer covers over the configuration of the breaking pattern. This multi layered construction forces the frangible layer of the seal to break open and tear only in the weaker area of the breaking pattern when sufficient internal container pressure is applied to the seal. When the seal bursts open, the configuration of the breaking pattern also forms a connector that keeps the broken open central portion of the seal attached to the annular section of the seal remaining bonded to the rim of the container pour spout thereby eliminating any contamination of the dispensed contents.

The principal feature of the invention is to provide a leak proof self opening frangible seal for the opening of the container pour spout that is both, strong enough to remain intact when the seal is subjected to the pressure created when a consumer grips and inverts the filled uncapped container, and also, weak enough to burst open when a certain amount of additional pressure is applied to the seal when a consumer squeezes the inverted container. This allows the container to be inverted and the pour spout to be inserted into the fill opening without spilling any of the liquid contents. The seal is then burst open by a consumer squeezing the container which allows the contents to dispense out through the open pour spout thereby eliminating the need for an opening tool or fill funnel.

REFERENCE NUMERALS IN DRAWINGS

Figure 1:
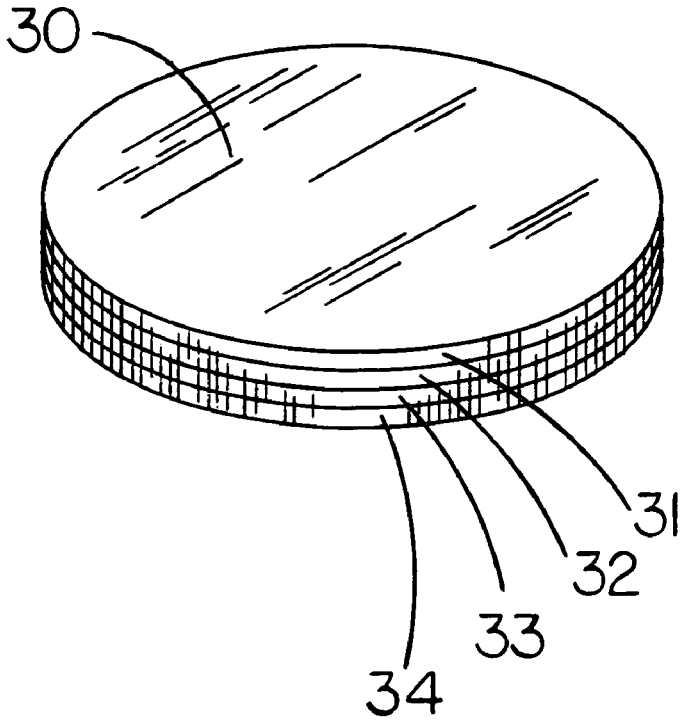
FIG. 1 illustrates a perspective view of a pressure activated self opening multi layered frangible container seal.

30. Seal
31. Frangible layer
32. First adhesive layer
33. Template layer
34. Second adhesive layer
35A. Breaking pattern
35L. Breaking pattern
36. Surface area
37. Uncut area
38. Flap
39. Peripheral portion
40. Pour spout
41. Pour spout opening
42. Container
43. Container body portion
44. Container bottom end
45. Container bottom wall end
46. Container top end
47. Pour spout rim
48. Closure cap
49. Fill opening
50. Additional material layer
51. Releasable adhesive layer
52. Inner planar surface of closure cap
53. Strip with centered breaking patterns
54. Strip with random breaking patterns

DETAILED DESCRIPTION OF THE PREFERRED EMBODIMENTS

Figure 7:
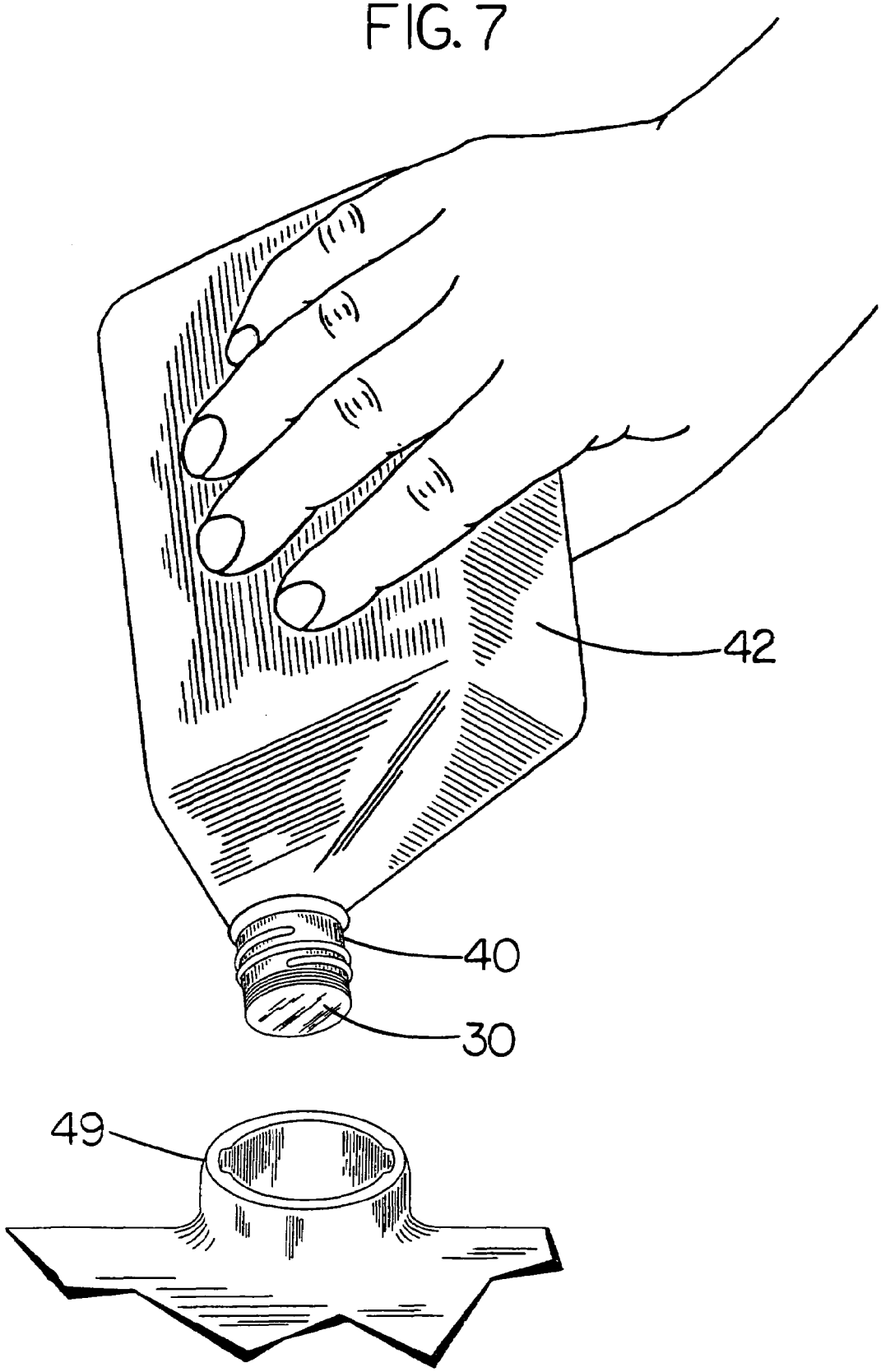
FIG. 7 illustrates a perspective view of the installed seal remaining intact while the container is held in an inverted position by a consumer.
Figure 8:
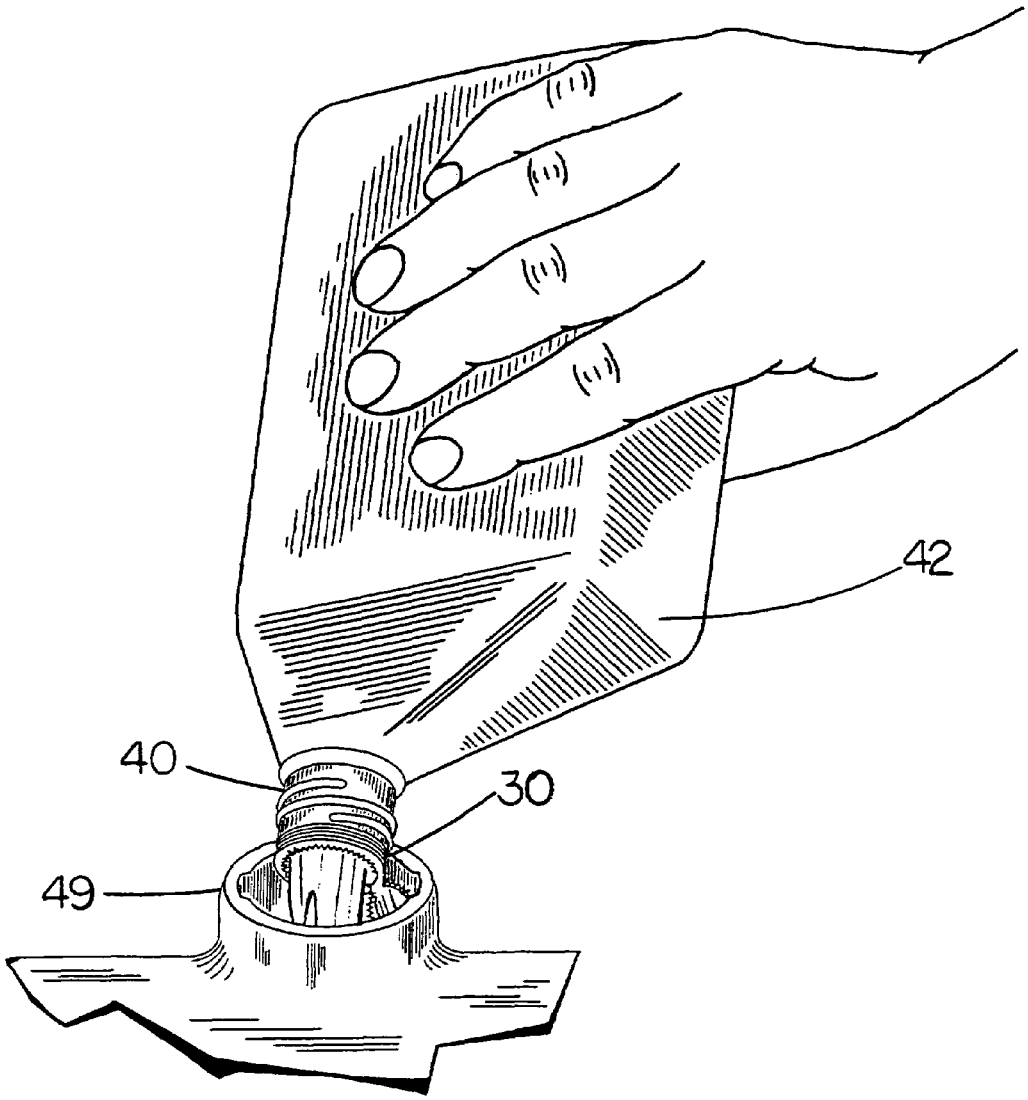
FIG. 8 illustrates a perspective view of the container dispensing the liquid contents after the seal is broken open by a consumer squeezing the inverted container.
Figure 9:
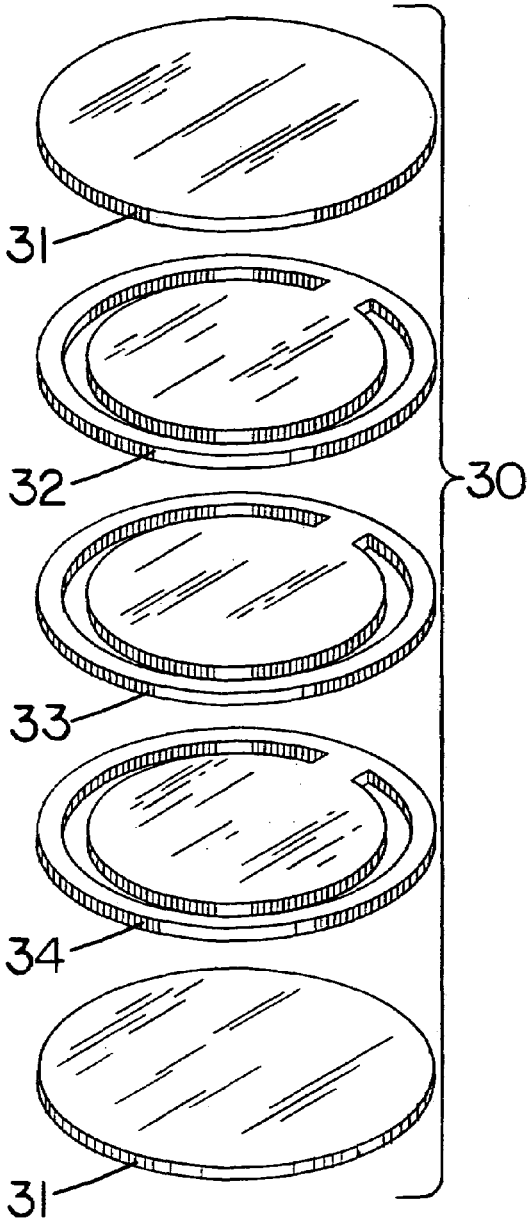
FIG. 9 illustrates an exploded view of an additional embodiment of the multi layered seal showing the structural function of the individual layers.

FIG. 1 Illustrates a perspective view of a leak proof pressure activated self opening frangible seal 30 for sealing over the pour spout 40 opening 41 of flexible containers 42 of the type used for the storage and dispensing of various pourable liquids, such as motor oil or transmission fluid and the like, that is only of sufficient strength to remain intact when the filled uncapped container 42 is gripped by a consumer and held in an inverted position as shown in FIG. 7. At the same time the seal 30 is also of sufficient weakness to break open in a specific configuration and dispense the liquid contents when the internal container 42 pressure is further increased by a consumer squeezing the inverted container 42 as shown in FIG. 8.

Figure 2:
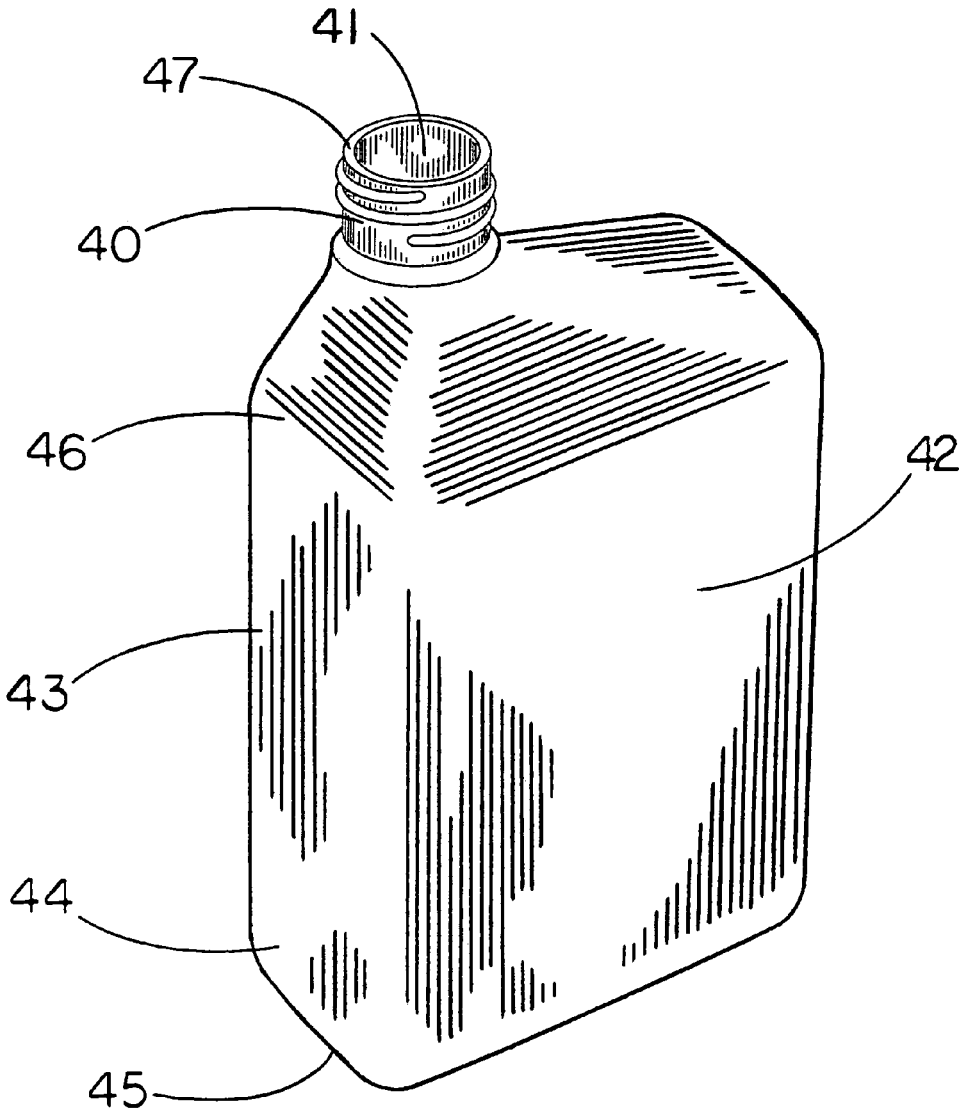
FIG. 2 illustrates a perspective view of a flexible container that is to be sealed with the closure seal of drawing FIG. 1.

FIG. 2 illustrates a perspective view of the container 42 comprised of a tubular body portion 43 with a bottom end 44 sealed by an integral wall end 45 and an opposite top end 46 forming a pour spout 40 with an opening 41 that ends with a perpendicular exterior rim 47 that provides a surface area for bonding the seal 30 over the opening 41.

Figure 3:
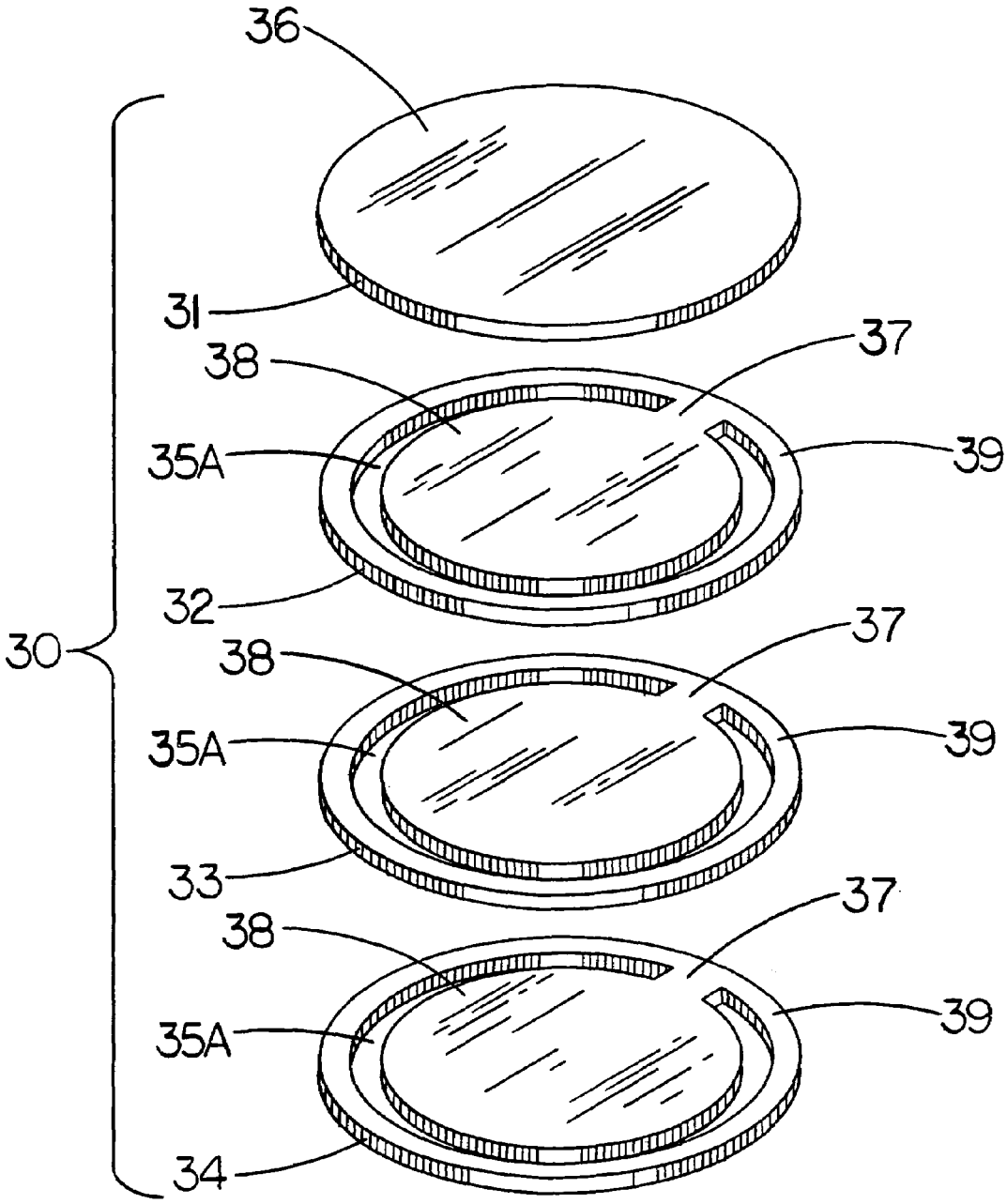
FIG. 3 illustrates an exploded view of the multi layered seal showing the differing individual layers.

FIG. 3 illustrates an exploded view of the seal 30, constructed of a first layer 31 of leak proof breakable material, herein referred to as the frangible layer 31, comprised of one or more layers of either; metal foil, polymers, plastic, paper, or combinations thereof. The frangible 31 layer is bonded by a second layer 32 of material, comprised of adhesive, to a third layer 33 of material comprised of one or more layers of either; metal foil, polymers, plastic, paper, adhesive, or combinations thereof and is herein referred to as the template layer 33. A fourth layer 34 of adhesive is applied to the template layer 33 enabling the seal 30 invention to be bonded over the pour spout 40 opening 41 of flexible type containers 42 by various means such as, but not limited to; heat, ultrasonic, reactive, evaporative, pressure sensitive, or induction sealing.

Figure 4:
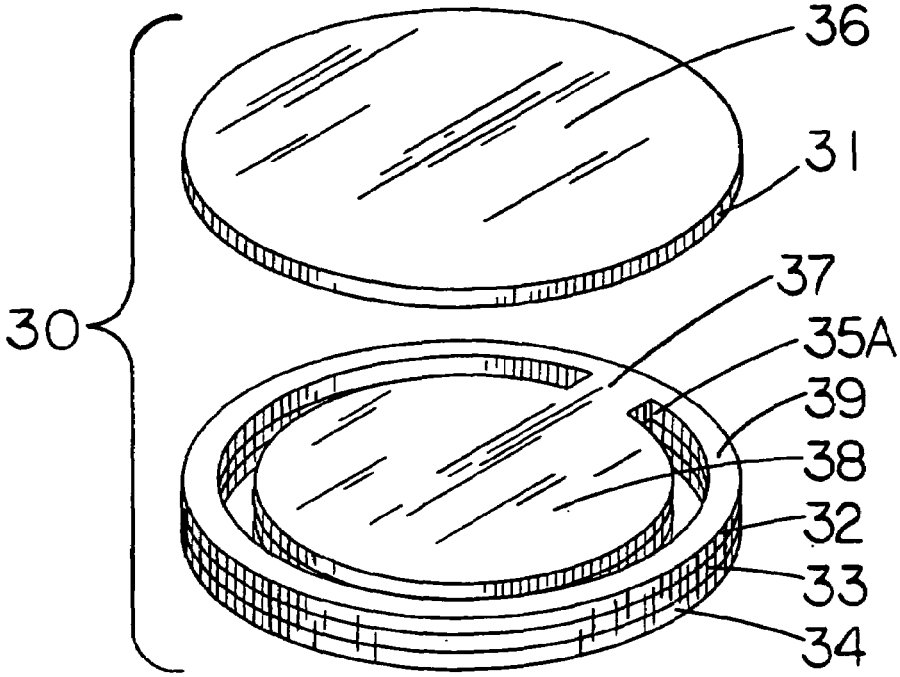
FIG. 4 illustrates a partially exploded view of the multi layered seal showing the structural function of each of the individual layers.

As further shown in the exploded view of FIG. 3 and the partially exploded view of FIG. 4, the template layer 33 together with the adhesive layers 32 and 34 respectively, contain a variable cut through and/or cut out void configuration forming a flap 38 and is herein referred to as the breaking pattern 35A. The breaking pattern 35A can be cut into the template layer 33 that has either none, one, or both of the adhesive layers 32 and 34 already applied, which allows duplicate breaking pattern 35A configurations to be cut into the template layer 33 and either, none, one, or both of the adhesive layers 32 and 34 respectively, in a single step or, after the breaking pattern 35A is cut into the template layer 33, either one or both of the adhesive layers 32 and 34 can be applied to the template layer 33 by various means known to those skilled in the art such as, but not limited to; spraying, rolling, or thin film application. In either process there is no adhesive spanning the cut through and/or cut out void area of the breaking pattern 35A configuration that has been cut into the template layer 33 as further shown in FIG. 4.

As further shown in FIG. 1, the frangible layer 31 is then bonded to the template layer 33 and the adhesive layer 34 by the adhesive layer 32 to form the substantially leak proof seal 30 that is comprised of multiple layers everywhere, except in the area of the breaking pattern 35A, where the seal 30 is comprised of only the single frangible layer 31 that must be broken to break open the seal 30.

Figure 5:
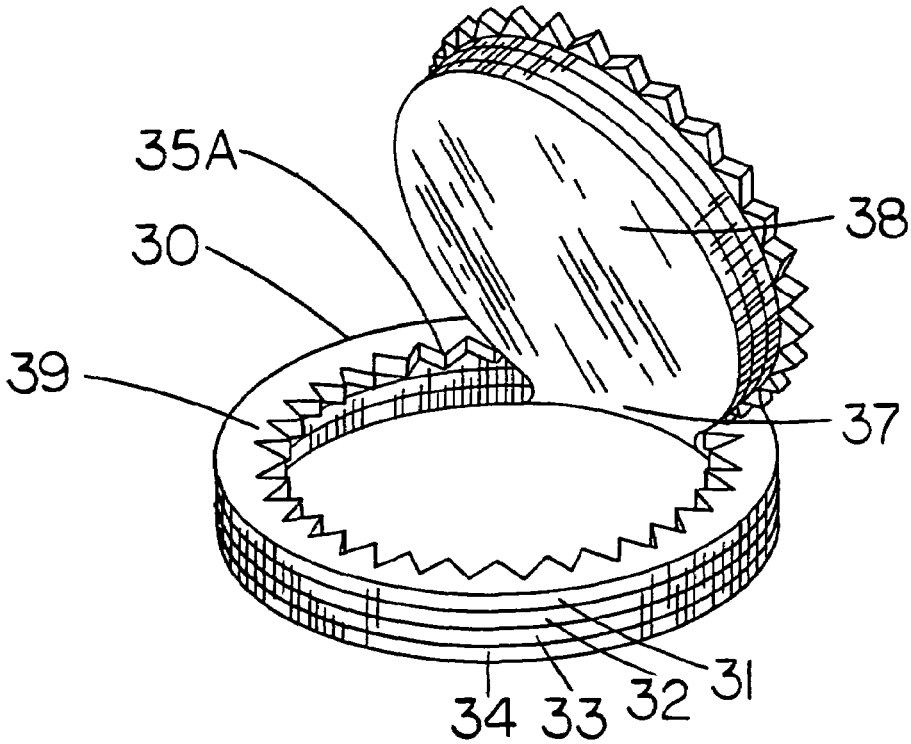
FIG. 5 illustrates a perspective view of the seal in a broken open condition.

As shown in FIG. 5, this multi layered construction leaves the surface area 36 of the seal 30 relatively weaker only in the area where the single frangible layer 31 covers over the area of the breaking pattern 35A configuration, while making the remaining multi layered surface area 36 of the seal 30 relatively stronger which forces the seal 30 to break open only in the weaker single frangible layer 31 area of the breaking pattern 35A configuration forming the flap 38 when sufficient internal container 42 pressure is brought to bear against the seal 30 as further shown in FIG. 5.

Figure 6:
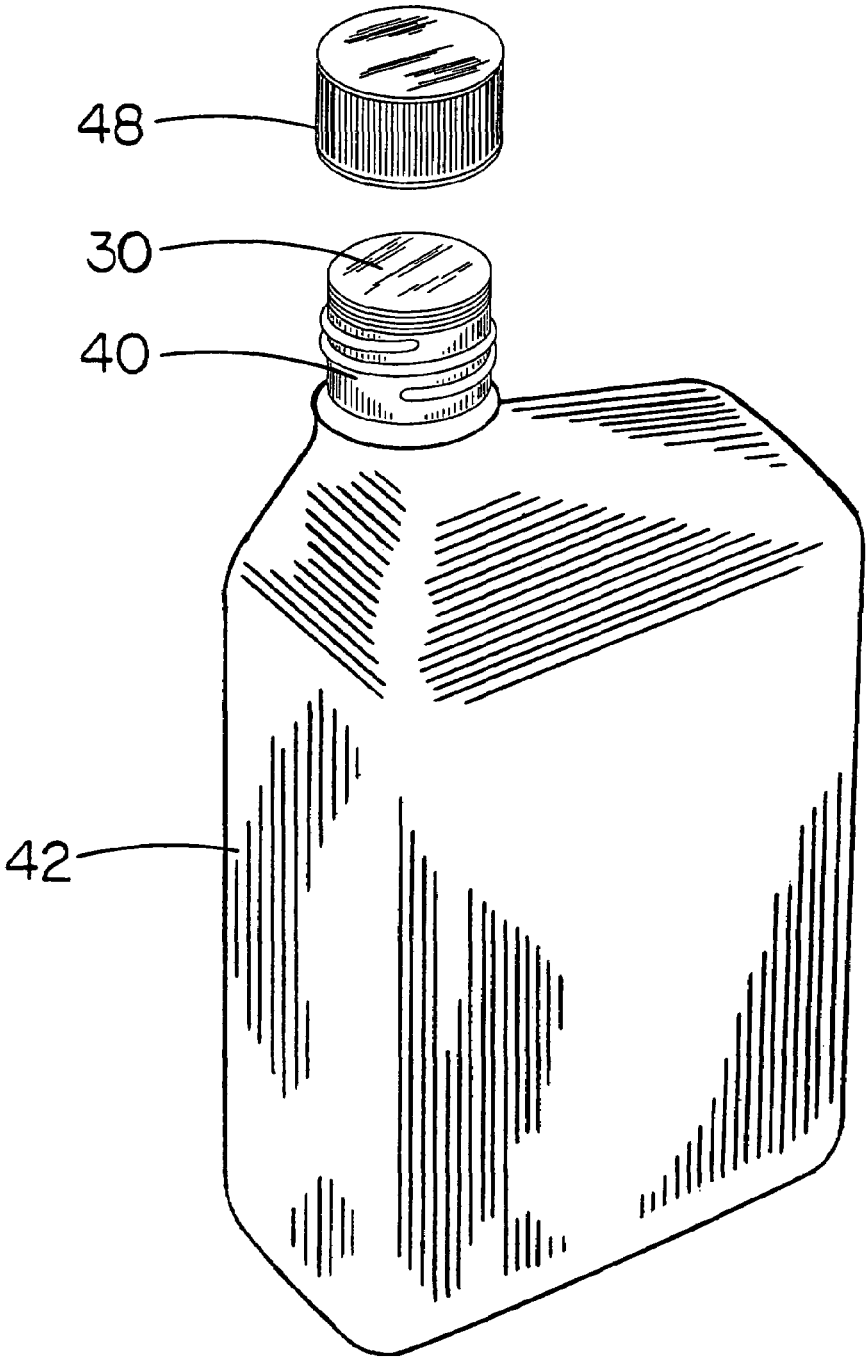
FIG. 6 illustrates a perspective view of the seal installed on the flexible container with an accompanying closure cap.

FIG. 6 shows a perspective view of the container 42 with the seal 30 invention bonded over the pour spout 40 opening 41 providing a leak proof closure. The pour spout 40 includes means for attaching a conventional closure cap 48. The closure cap 48 can be secured by using screw threads as further shown in FIG. 6, or the cap 48 may be attached by various other means such as pressure fitting.

FIG. 7 shows that when the closure cap 48 is removed, the seal 30 is of sufficient strength to remain intact when subjected to the pressure created by the weight of the liquid contents and the additional internal container 42 pressure generated when a consumer grips and holds the container 42 in an inverted position.

FIG. 8 shows that when an set amount of additional internal container pressure is brought to bear against the seal 30 by a consumer manually squeezing or striking the filled uncapped container 42 while held in the inverted position, the seal 30 is also sufficiently weak enough to break open outwardly only in the configuration of the breaking pattern 35A. The seal 30 invention allows a consumer to grip and invert the container 42 without the contents spilling out before the pour spout 40 of the container 42 can be inserted into the intended fill opening 49. The seal 30 is then broken open by the consumer manually squeezing or striking the inverted container 42 to dispense the liquid contents only into the intended fill opening 49 thereby eliminating the need for an opening device or fill funnel as further shown in FIG. 8.

As further shown in FIG. 5, a portion of the breaking pattern 35A that forms the flap 38, includes an uncut area 37 that serves a three fold purpose. First, the uncut area 37 acts as a hinge that allows the flap 38 to swing outward after being broken open, and, at the same time, holds the flap 38 in the open position. Second, the uncut area 37 serves as a connector that keeps the open flap 38 from tearing away from the peripheral portion 39 of the seal 30 remaining bonded to the pour spout 40 rim 47 and contaminating the container 42 contents when dispensed, as shown in FIG. 8. Third, the uncut area 37 serves as a connector that allows the consumer to pull the broken flap 38, and the peripheral portion 39 of the seal 30 remaining bonded to the container 42 rim 47, from the rim 47, thereby allowing the container 42 to be recycled without being contaminated by any of the seal 30 material.

Figure 10:
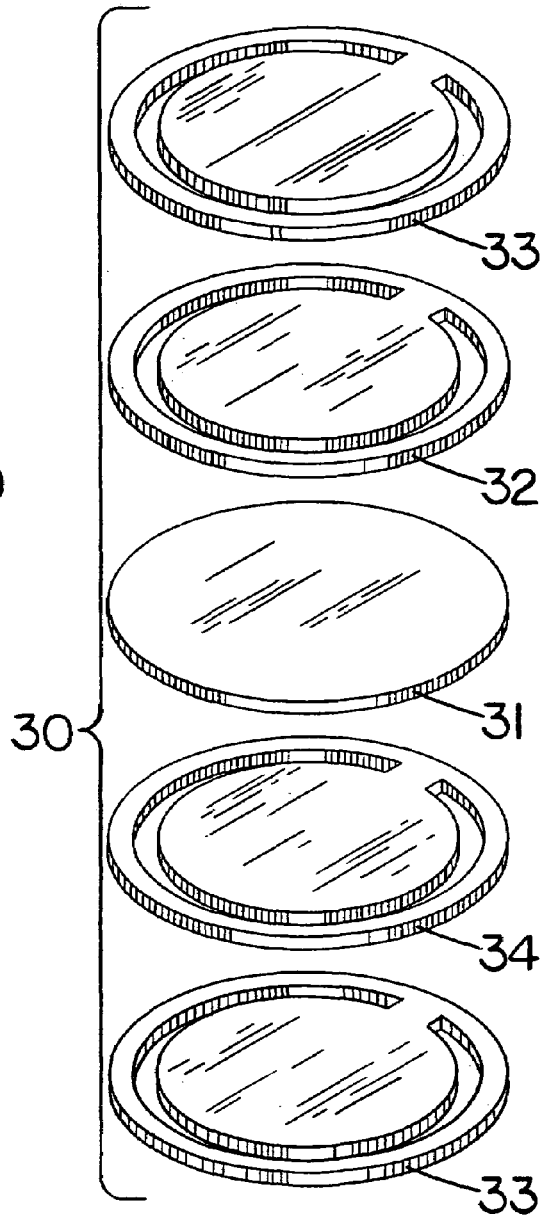
FIG. 10 illustrates an exploded view of another embodiment of the multi layered seal showing the structural function of the individual layers.

FIG. 10 illustrates an exploded view of another embodiment of the seal 30 invention showing a first template layer 33 bonded to the frangible layer 31 by the adhesive layer 32 with a second template layer 33 bonded to the opposite side of the frangible layer 31 by the adhesive layer 34. The seal can then be bonded to the pour spout 40 rim 47 with an additional layer of adhesive that is already applied to either template layer 33 before the breaking pattern 35A is cut, or the adhesive can be applied only to the area of the seal 30 contacting the rim 47, or the adhesive can be applied to the rim 47 of the pour spout 40 itself.

Figure 11:
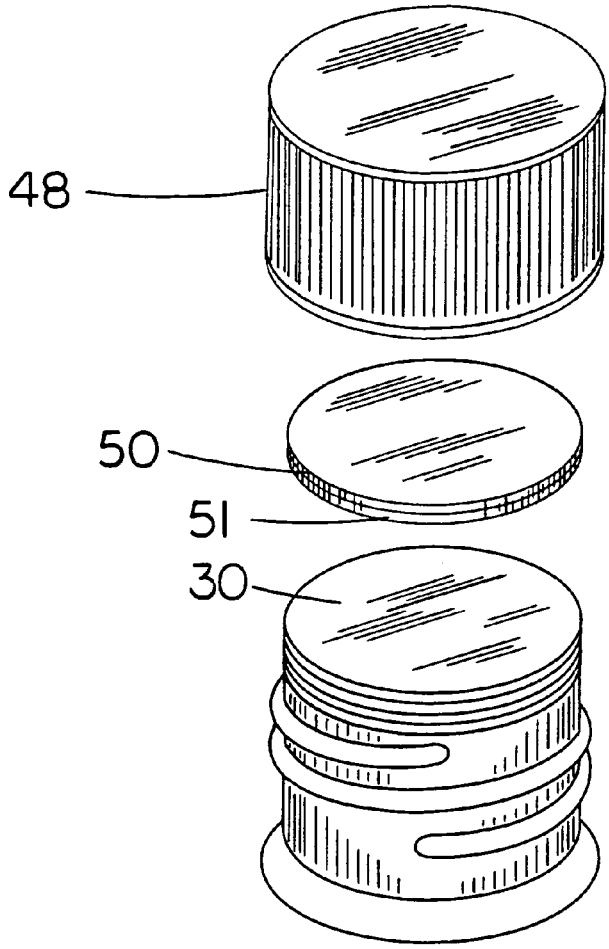
FIG. 11 illustrates an exploded view of the seal installed over the pour spout opening of the flexible container with additional layers of material that allow the seal to be inserted into the closure cap as a single disk and installed by using the induction sealing process.
Figure 12:
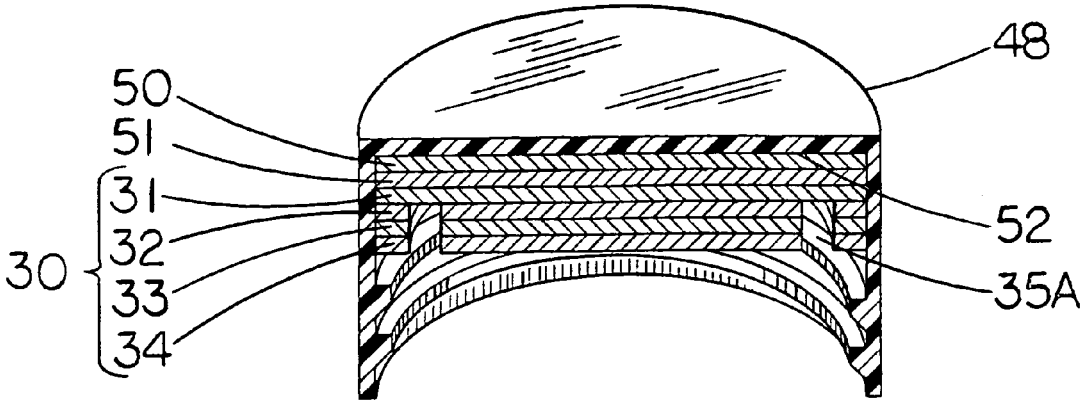
FIG. 12 illustrates a further cut away view of the seal together with the additional layers that allow the seal to be inserted into the closure cap and installed over the pour spout opening by using the induction sealing process.

As shown in FIG. 11 and FIG. 12, the seal 30 can also include one or more additional layers of material providing means for the seal 30 to be bonded over the container 42 pour spout 40 opening 41 by induction heat sealing. A first layer of additional material 50 comprised of one or more layers of either; pulp, polymers, absorbent material or combinations thereof, is bonded to the seal 30 by a second layer of additional material 51 consisting of a releasable adhesive. Bonding the material layer 50 to the seal 30 with the releasable adhesive layer 51 allows the seal 30, in combination with the layers 50 and 51, to be inserted and held inside the container 42 closure cap 48 which is then secured over the pour spout 40 opening 54 of the container 42.

The container 42 is then passed through an induction sealer which heats the seal 30 to a temperature sufficient to bond the seal 30 to the pour spout 40 rim 47 and simultaneously melt the releasable adhesive layer 51 which is then absorbed into the material layer 50 thereby releasing the seal 30 from the material layer 50. The material layer 50 is then retained inside the closure cap 48 after the removal of the closure cap 48 from the pour spout 40 leaving only the seal 30 bonded over the pour spout 40 opening 41 as further shown in FIG. 6.

As further shown in the cut away view of FIG. 12, the inner upper planar surface area 52 of the closure cap 48 is substantially flat and when secured to the container 42 pour spout 40 in the closed position, is held flat against the outer surface of the seal 30, and any additional layers of material 50 and 51, thereby preventing the seal 30 from breaking open and dispensing the container 42 contents prior to removing the closure cap 48.

Figure 13:
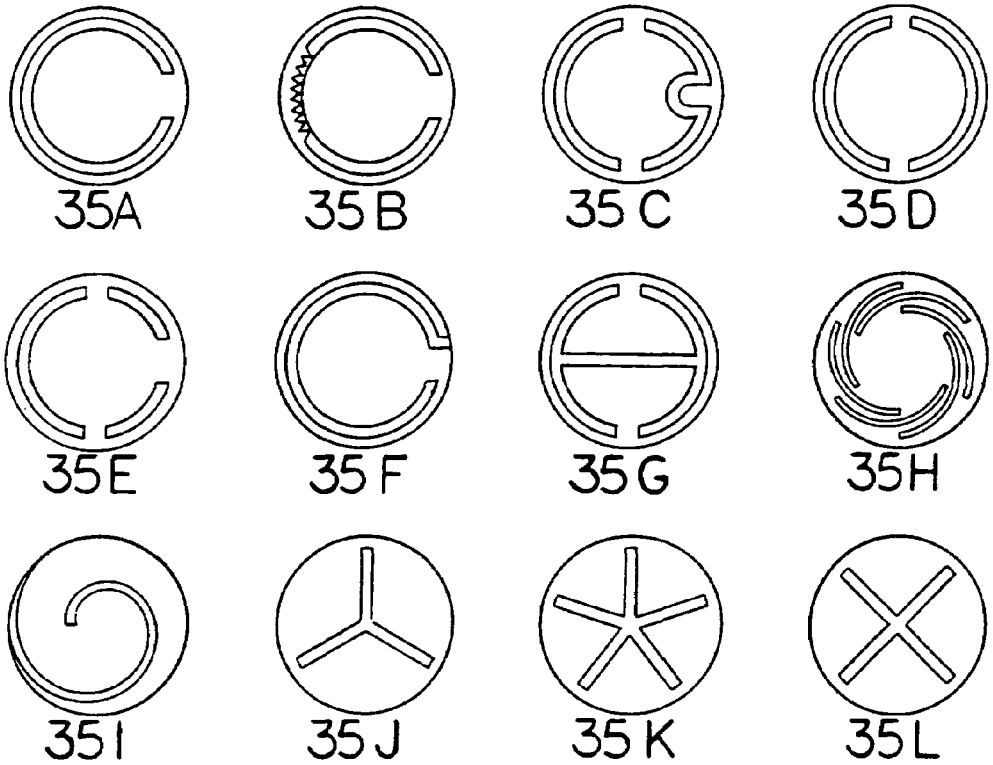
FIG. 13 illustrates a plurality of different configurations that may be used to form the breaking pattern of the template layer of the seal.

FIG. 13 shows a plurality of different breaking pattern configurations numbered 35A through 35L that may be used to fabricate the template layer 33. The configuration of the breaking pattern 35A shown in FIGS. 3, 4, 5, 8, 9, and 10, though preferred, is used to illustrate the function of the seal 30 invention and not to limit the embodiments described herein only to the breaking patterns shown in FIG. 13.

Figure 14:
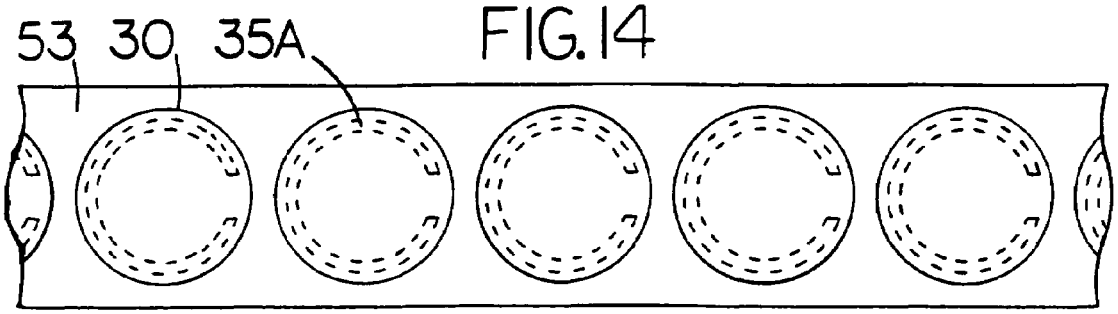
FIG. 14 illustrates a hidden view of repeating breaking pattern configurations that are centered within the seal disk as they are die cut out from a continuous strip of the multi layered seal material.
Figure 15:
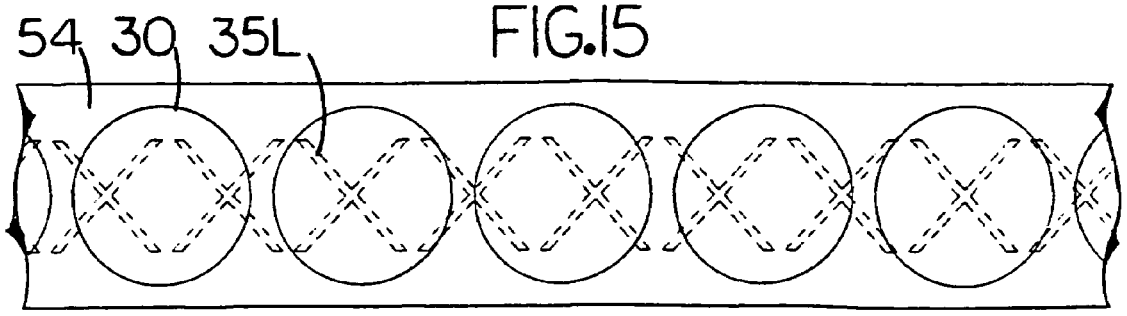
FIG. 15 illustrates a hidden view of repeating breaking pattern configurations that are in close enough proximity to one another to allow the seal disks to be cut out from a continuous strip of the multi layered seal material at any point along the strip and contain enough of one or more of the breaking patterns within the circumference of the seal disk to allow the seal to function properly.

Using the breaking pattern 35A, as shown in FIG. 13, the seal 30 disk can be cut out of a continuous strip 53 of the multi layered seal material wherein the disk cutter is in register with each individual breaking pattern 35A and cuts out the seal 30 disk with a single breaking pattern 35A substantially centered within the circumference of the seal 30 disk, as shown in the hidden view in FIG. 14, or, using the breaking pattern 35L as shown in FIG. 13, the seal 30 disk can be cut out of a continuous strip 54 of the multi layered seal material wherein the breaking pattern 35L is of a size, and is repeated in the strip 54 in close enough proximity to one another, to allow the seal 30 disk to be cut out of the strip 54 at any point along the strip 54, and contain enough of one or more of the repeating breaking patterns 35L within the circumference of the seal 30 disk for the seal 30 invention, when bonded over a container opening to function as intended, as shown in FIG. 15.

The template layer 33 side of the seal 30 may be bonded over the container 42 pour spout 40 opening 41 as described herein, or alternately, the frangible layer 31 side of the seal 30 may also be bonded over the pour spout 40 opening 41 by applying adhesive to the frangible layer 31 only where the seal 30 contacts the rim 47 of the pour spout 40 or by applying adhesive to the rim 47 of the pour spout 40 itself.

The adhesive layer 34 can be eliminated when either; the seal 30 is to be bonded over the container 42 pour spout 40 opening 41 by the application of the adhesive to the rim 47 of the pour spout 40 itself; or the frangible layer 31 side of the seal 30 is to be bonded over the container 42 opening 41.

The adhesive layer 32 can be eliminated when the frangible layer 31 is to be bonded directly to the template layer 33 by various means known to those skilled in the art such as, but not limited to, cladding or fusion bonding and the like.

When the template layer 33 consists of adhesive, the adhesive layer 32, the template layer 33, and the adhesive layer 34 can be combined and applied to the frangible layer 31 in a single process. When the combined layers of adhesive are applied to the frangible layer 31, the breaking pattern 35A is formed by leaving an area in the configuration of the breaking pattern 35A uncoated. This leaves the surface area 36 of the multi layered seal 30 relatively weaker only in the uncoated area of the single frangible layer 31 while making the multi layered coated area of the seal 30 relatively stronger which forces the seal 30, when bonded over the container 42 pour spout 40 opening 42, to break open and tear only in the single weaker frangible layer 31 area of the breaking pattern 35A configuration.

The adhesive layers 32 and 34 may be comprised of one or more layers of different types of adhesives such as, but not limited to, hot melt adhesives of the same or differing bonding temperatures, one or more part reactive adhesives, evaporative adhesives, or pressure sensitive adhesives that may incorporate an additional protective peel off layer that is removed after the breaking pattern 35A is cut into the adhesive layer 32, the template layer 33 and the adhesive layer 34 in a single step, allowing the frangible layer 31 to be then applied to the template layer 33 by pressure.

The pressure required to break open the seal 30 when bonded over the container 42 pour spout 40 opening 41 can be adjusted by; increasing or decreasing the thickness of the material used in the frangible layer 31, by the choice of material used in the frangible layer 31, by the configuration of the breaking pattern used in the template layer 33, or combinations of one or more of these.

The size and shape of the container 42 shown in drawing FIGS. 2, 6, 7, and 8 is used as an example to illustrate the function of the seal 30 invention and not to limit the application of the embodiments to a container of a particular size or shape.

Although the present invention has been described in terms of specific embodiments thereof, the invention claimed is not so restricted. It will be apparent to those skilled in the art that it is possible to modify and alter features of the invention while remaining within the spirit and scope of the inventive concept. Variations of the embodiments may be made without departing from the invention in its broader aspect such as: various breaking pattern configurations and dimensions not shown in the drawings may also be used; various other materials not described herein may be substituted for the seal 30 layers; various other adhesives not described herein may be adopted; the construction of the container 42 may vary from the illustrations shown in the drawings such as including accordion type bellows that allow the container 42 to be compressed; the container 42 may contain additional types of pourable material; any number of additional alternating frangible 31 or template 33 layers may also be bonded to either side of the multi layered seal 30 invention. The seal 30 may be installed over the container 42 pour spout 40 opening 41 without the use of the additional material layers 50 or 51 etc. Thus the scope of the invention should be determined by the appended claims and their legal equivalents, rather than by the examples given.

Thus having described the invention, I claim:

1. A leak proof pressure activated self opening closure seal for sealing over a dispensing opening of a flexible container used for containing and dispensing pourable material, said flexible container comprising: (a) a tubular body portion with a sealed bottom end, an opposite top end forming a pour spout that includes means for securing a closure cap; said pour spout ending with an exterior rim providing a surface area for bonding said closure seal over said dispensing opening of said pour spout; (b) said closure seal comprising: a first layer of frangible sheet material, a second layer of adhesive, a third layer of strengthening sheet material, a fourth layer of adhesive; (c) wherein said first layer of frangible sheet material, said second layer of adhesive, said third layer of strengthening sheet material, and said fourth layer of adhesive are permanently laminated together forming said closure seal; (d) wherein said second layer of adhesive, said third layer of strengthening sheet material and said fourth layer of adhesive each contain a duplicate cut out void configuration that are in alignment with each other; (e) wherein said duplicate cut out void configuration creates a weak area in said closure seal by leaving only said first layer of frangible sheet material covering over said duplicate cut out void configuration; (f) wherein an annular portion of said closure seal is bonded to said exterior rim of said flexible container by said fourth layer of adhesive sealing over said dispensing opening of said pour spout; (g) wherein said closure seal is of sufficient strength to remain intact and retain said pourable material in said flexible container when said flexible container is gripped, uncapped and inverted by a consumer; (h) wherein said closure seal is of sufficient weakness to break open only in said weak area of said duplicate cut out void configuration thereby allowing said pourable material to dispense from said pour spout when said flexible container is pressurized by said consumer squeezing or striking said flexible container.

2. The closure cap of claim 1, wherein an inner planar surface of said closure cap is in contact with said closure seal when said closure cap is installed on said flexible container preventing said closure seal from breaking open prior to the removal of said closure cap from said flexible container.

3. The duplicate cut out void configuration of claim 1, wherein said duplicate cut out void configuration includes one or more uncut portions that connect one or more broken open center flaps of said closure seal to the annular portion of said closure seal remaining bonded to said exterior rim thereby preventing said one or more broken open center flaps from tearing from said annular portion when said closure seal breaks open.

4. The duplicate cut out void configuration of claim 1, wherein said duplicate cut out void configuration can comprise either a: varied C shaped, H shaped, three or more point star shaped, X shaped, wave shaped, spiral shaped, or circular shaped configuration.

5. The closure seal of claim 1, wherein said annular portion of said closure seal is bonded to said exterior rim by: induction sealing, heat sealing, evaporative sealing, reactive sealing, or ultrasonic sealing.

6. The first layer of frangible sheet material of claim 1, wherein said first layer of frangible sheet material is made up of one or more layers of same or different materials wherein said materials are: metal foil, polymers, plastic, or paper.

7. The third layer of strengthening sheet material of claim 1, wherein said third layer of strengthening sheet material is made up of one or more layers of same or different materials wherein said materials are: metal foil, polymers, plastic, paper or adhesive.

8. The closure seal of claim 1, wherein said closure seal includes one or more additional layers of same or different sheet materials, wherein said sheet materials are: metal foil, plastic, polymers, synthetic foam, pulp board, paper, adhesive, or releasable adhesive; providing means for bonding said closure seal to said exterior rim; and wherein said means for bonding comprising induction sealing, heat sealing, evaporative sealing, reactive sealing, or ultrasonic sealing.

9. The fist layer of frangible sheet material of claim 1, wherein said first layer of frangible sheet material is permanently laminated to said third layer of strengthening sheet material by non adhesive means, wherein said non adhesive means comprising cladding or fusion bonding.

10. The pourable material of claim 1, wherein said pourable material can be one of motor oil, transmission fluid, motor vehicle additives, lubricants or chemicals.

11. A leak proof pressure activated self opening closure seal for sealing over the dispensing opening of a flexible container used for storing and dispensing pourable liquid, comprising: (a) a first layer of strengthening sheet material, a second layer of adhesive, a third layer of frangible sheet material, a fourth layer of adhesive, a fifth layer of strengthening sheet material; (b) wherein said first layer of strengthening sheet material, said second layer of adhesive, said third layer of frangible sheet material, said fourth layer of adhesive, and said fifth layer of strengthening sheet material are permanently laminated together forming said closure seal; (c) wherein said first layer of strengthening sheet material, said second layer of adhesive, said fourth layer of adhesive, said fifth layer of strengthening sheet material each contain a duplicate cut out void configuration that are in alignment with each other; (d) wherein said duplicate cut out void configuration creates a weak area in said closure seal by leaving only said third layer of frangible sheet material in said weak area of said cut out void configuration; (e) wherein an annular portion of said closure seal is adhesively bonded to said exterior rim of said flexible container sealing over said dispensing opening; (f) wherein said dispensing opening is closed with a closure cap; (g) wherein said closure cap includes an inner planar surface that is in contact with said closure seal preventing said closure seal from breaking open prior to the removal of said closure cap from said flexible container; (h) wherein said closure seal is of sufficient strength to remain intact and retain said pourable liquid in said flexible container when said flexible container is gripped, uncapped and inverted by a consumer; (i) wherein said closure seal is of sufficient weakness to break open only in said weak area of said duplicate cut out void configuration thereby allowing said pourable liquid to dispense from said dispensing opening when said flexible container is pressurized by said consumer squeezing or striking said flexible container; (j) wherein said duplicate cut out void configuration includes one or more uncut portions that connect one or more broken open center flaps of said closure seal to the annular portion of said closure seal remaining bonded to said dispensing opening thereby preventing said one or more broken open center flaps from tearing from said annular portion when said closure seal breaks, open; (k) wherein said duplicate cut out void configuration can comprise either a: varied C shape, H shaped, three or more point star shaped, X shaped, wave shaped, spiral shaped, or circular shaped configuration; (l) wherein said first layer of strengthening sheet material and said fifth layer of strengthening sheet material are comprised of one or more layers of same or different materials wherein said materials are: metal foil, plastic, polymers, paper, or adhesive; (m) wherein said third layer of frangible sheet material is comprised of one or more layers of same or different materials wherein said materials are: metal foil, plastic, polymers, or paper; (n) wherein said closure seal includes one or more additional layers of same or different sheet materials; wherein said sheet materials are: metal foil, plastic, polymers, synthetic foam, pulp board, paper, adhesive or releasable adhesive; providing means for bonding said closure seal to said exterior rim; (o) wherein said means for bonding said closure seal to said exterior rim comprise induction sealing, heat sealing, evaporative sealing, reactive sealing or ultrasonic sealing; (p) wherein said first layer of strengthening sheet material and said fifth layer of strengthening sheet material are permanently laminated to said third layer of frangible sheet material by non adhesive means; (q) wherein said non adhesive means comprising cladding or fusion bonding; (r) wherein said pourable liquid includes either one of motor oil, transmission fluid, motor vehicle additives, lubricants or chemicals.

* * * * *